US008881419B2

(12) United States Patent
Madrack

(10) Patent No.: US 8,881,419 B2
(45) Date of Patent: Nov. 11, 2014

(54) DECK PLANK SPACER AND FASTENER GUIDE TOOL

(71) Applicant: Mark Madrack, Berlin, NJ (US)

(72) Inventor: Mark Madrack, Berlin, NJ (US)

( * ) Notice: Subject to any disclaimer, the term of this patent is extended or adjusted under 35 U.S.C. 154(b) by 152 days.

(21) Appl. No.: 13/765,120

(22) Filed: Feb. 12, 2013

(65) Prior Publication Data

US 2014/0223755 A1 Aug. 14, 2014

(51) Int. Cl.
*E04F 21/00* (2006.01)

(52) U.S. Cl.
CPC ..... *E04F 21/0092* (2013.01)
USPC ..... 33/526; 33/645

(58) Field of Classification Search
USPC ..... 33/526, 613, 527, 645
See application file for complete search history.

(56) References Cited

U.S. PATENT DOCUMENTS

| | | | | | |
|---|---|---|---|---|---|
| 2,744,334 | A * | 5/1956 | Jondole | 33/613 |
| 4,850,114 | A * | 7/1989 | Vockins | 33/526 |
| 4,930,225 | A * | 6/1990 | Phillips | 33/526 |
| 4,955,142 | A * | 9/1990 | Rieck | 33/526 |
| 5,560,117 | A * | 10/1996 | Tallman | 33/526 |
| 5,997,209 | A * | 12/1999 | Sachs | 403/388 |
| 6,243,961 | B1 * | 6/2001 | Winski | 33/526 |
| 6,508,010 | B2 * | 1/2003 | Hanson et al. | 33/613 |
| D667,322 | S * | 9/2012 | Madrack | D10/65 |
| D668,562 | S * | 10/2012 | Madrack | D10/65 |
| D682,123 | S * | 5/2013 | Robinson | D10/64 |
| 8,793,889 | B2 * | 8/2014 | Hovren | 33/527 |
| 2007/0175176 | A1 * | 8/2007 | Lane | 52/749.1 |
| 2008/0178484 | A1 * | 7/2008 | Cother | 33/526 |
| 2014/0223755 | A1 * | 8/2014 | Madrack | 33/645 |

* cited by examiner

*Primary Examiner* — Yaritza Guadalupe-McCall
(74) *Attorney, Agent, or Firm* — Stuart M. Goldstein

(57) ABSTRACT

A deck plank spacer and fastener guide tool has a lightweight, unitary body having an elongated first bar member and a second bar member extending perpendicularly downward from the first bar member. A fastening guide member extends upwardly from and outwardly of the second bar member at an oblique angle in relation to the second bar member. An open slot extends completely through the fastening guide member for the insertion of a fastener, such as a nail or a bolt.

4 Claims, 4 Drawing Sheets

DECK PLANK SPACER AND FASTENER GUIDE TOOL

BACKGROUND OF THE INVENTION

During the construction of a deck which consists of a series of parallel aligned deck boards or planks, it is necessary to maintain uniform spacing between the secured planks. This not only provides an aesthetically acceptable appearance, but also permits rain or other surface water to drain through the deck and assist in ventilation of the structure. Current deck plank spacing techniques utilize nails, bolts, cumbersome spacing guide devices or merely the eyeballing estimates of the worker. None of these devices or methods allows the worker to quickly, efficiently and accurately properly position deck planks, while at the same time ensuring that the planks will be secured to the deck structure in this proper position.

SUMMARY OF THE INVENTION

It is thus the object of the present invention to provide a deck plank spacer tool which overcomes the limitations and disadvantages of existing spacer tools and plank spacer methods.

It is the object of the present invention to provide a deck plank spacer and fastener guide tool which accomplishes the objective of ensuring for accurate spacing between deck planks, but also allows for the contemporaneous connection of the deck plank to the deck structure by the appropriate fastener, e.g. nails or bolts, inserted into and connected to the deck structure at the same time the plank spacing takes place.

It is still another object of the present invention to provide a deck plank spacer and fastener guide tool which consists of a lightweight, unitary body which is readily portable and is economical to manufacture, package, and distribute.

These and other objects are accomplished by the present invention, a deck plank spacer and fastener guide tool comprising a lightweight, unitary body having an elongated first bar member and a second bar member extending perpendicularly downward from the first bar member. A fastening guide member extends upwardly from and outwardly of the second bar member at an oblique angle in relation to the second bar member. An open slot extends completely through the fastening guide member for the insertion of a fastener, such as a nail or a bolt.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
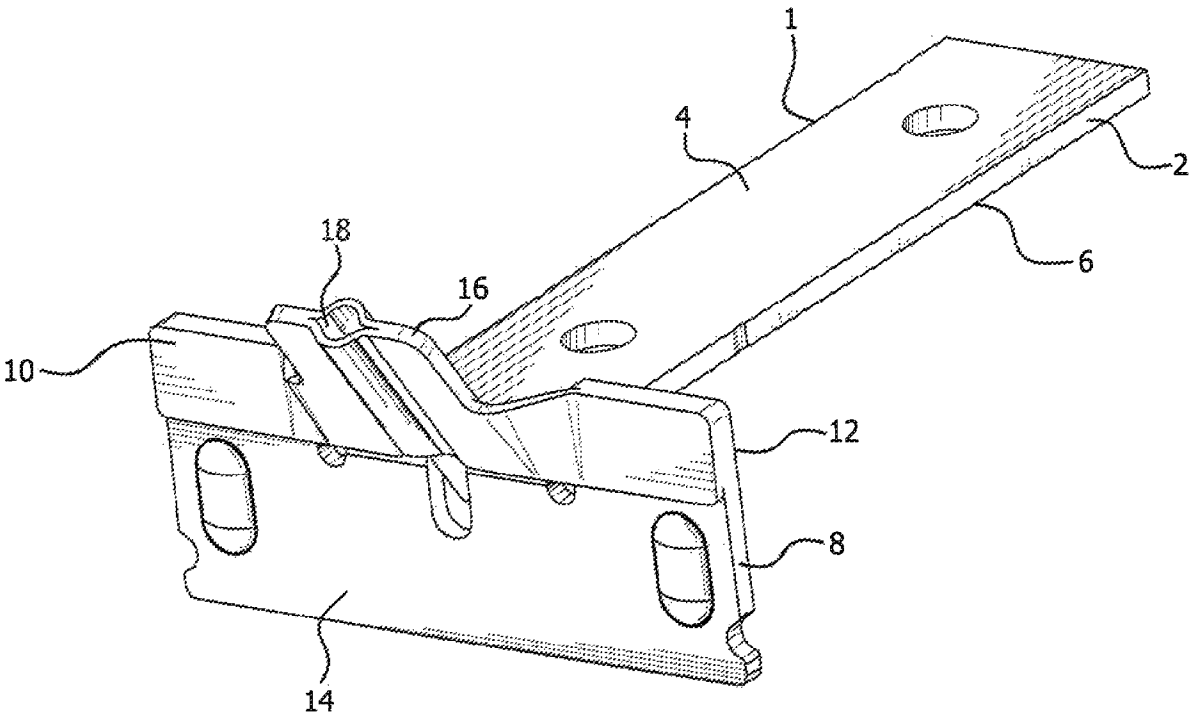
FIG. 1 is a perspective view of the deck plank spacer and fastener guide tool of the present invention.
Figure 2:
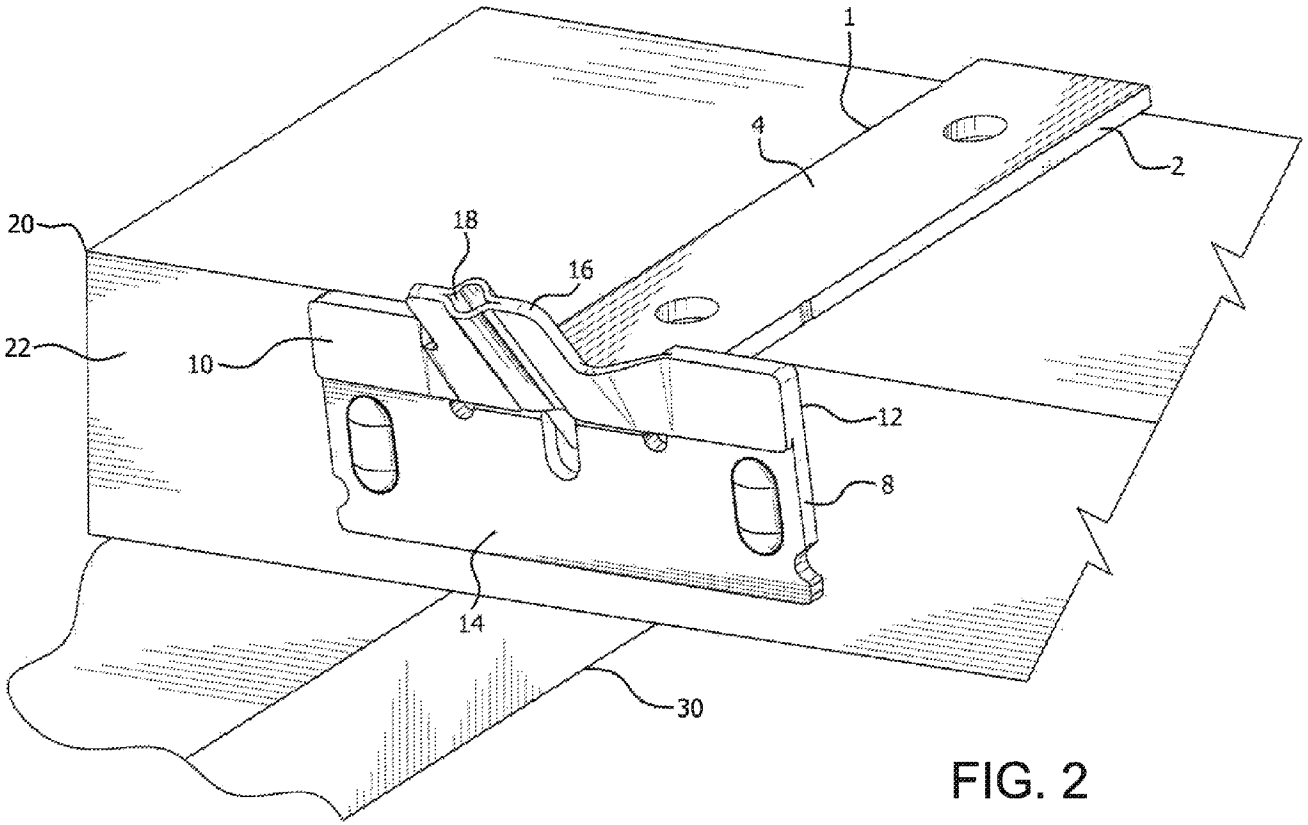
FIG. 2 is a front view of the deck plank spacer and fastener guide tool in use on a representative deck plank.
Figure 3:
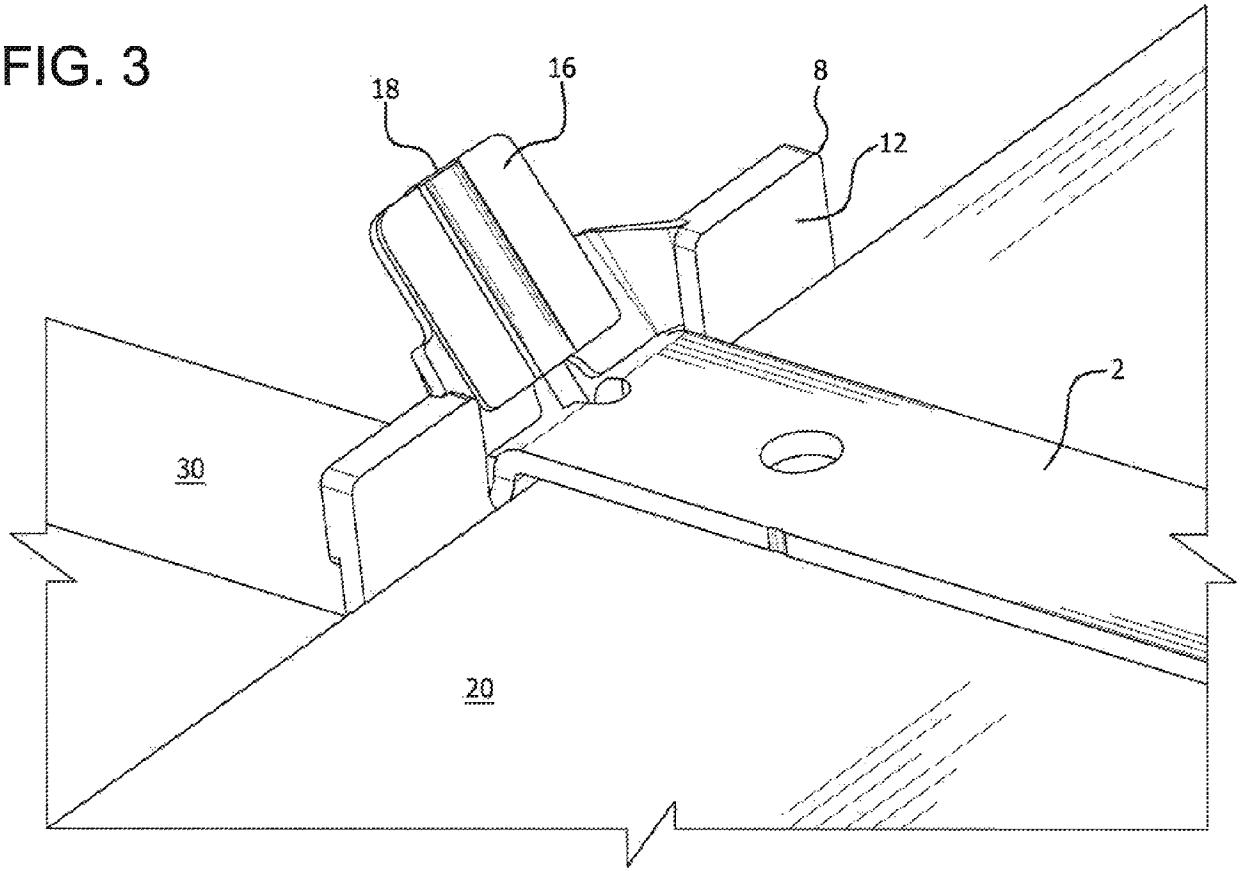
FIG. 3 is a rear view of deck plank spacer and fastener guide tool in use on a representative deck plank.

The deck plank spacer and fastener guide tool of the present invention comprises unitary, integral tool body 1 made of molded plastic. Tool body 1 can be fabricated as a single piece of lightweight metal or constructed out of components of metal, or equivalent durable lightweight material, welded together. Tool body 1 comprises an elongated plate-like bar member 2 having flat, smooth, top and bottom surfaces 4 and 6. Tool body 1 also comprises plate-like bar member 8 extending perpendicularly downward from one end of bar member 2. Bar member 8 comprises upper section 10 and flat and smooth inner and outer side surfaces 12 and 14.

Fastening guide member 16 extends upward from and outward of upper section 10 of bar member 8 at an oblique angle in relation to the bar member. Open slot 18 extends completely through fastening guide member 16.

In use, tool body 1 is positioned such that bar member 2 rests flush on deck plank 20, with bar member 8 overhanging the edge of the deck plank, and inner surface 12 of the bar member is flush with side 22 of the deck plank. It is contemplated that the width of bar member 8 is equivalent to the spacing or distance between the deck planks to be installed.

Figure 4:
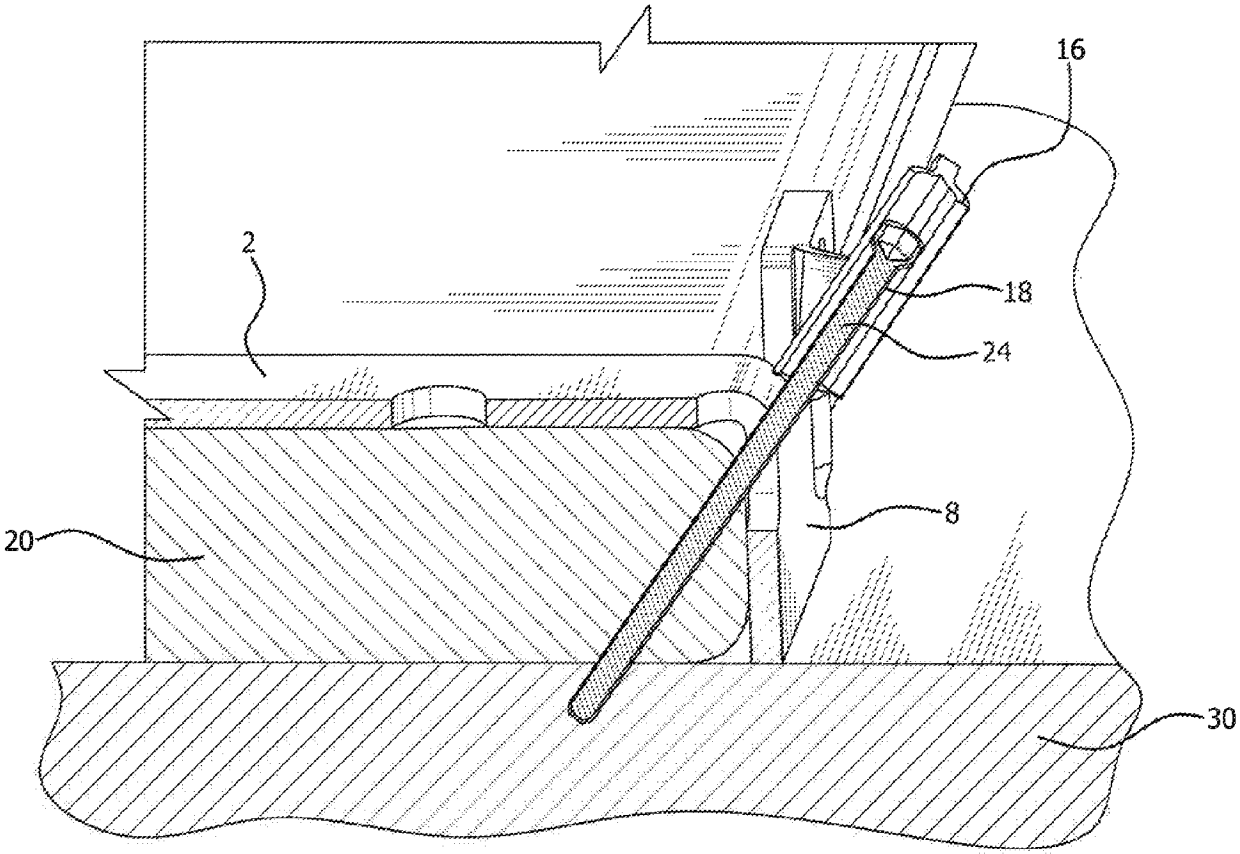
FIG. 4 is a partial cross-sectional view of deck plank spacer and fastener guide tool with a fastener being attached between a deck plank and deck support member.

Once tool body 1 is in position on deck plank 20, screw, nail, or equivalent fastener 24 is positioned within slot 18 of fastening guide member 16, and then nailed, screwed, or otherwise compelled through deck plank 20 into deck support member 30, to secure the deck plank to the deck support member. See FIG. 4. Tool body 1 is then lifted off deck plank 20 and placed on the next deck plank positioned adjacent to deck plank 20, to ensure proper spacing while that deck plank is secured to deck support member 30, with a fastener in the manner previously described.

Thus, the deck plank spacer and fastener guide tool of the present invention provides a lightweight, convenient, easy to use device which efficiently and effectively guarantees proper deck plank spacing, while providing means to contemporaneously fasten deck planks in this properly spaced position.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A deck plank spacer and fastener guide tool comprising an integral, unitary body having an elongated first plate-like bar member with smooth, flat bottom and top surfaces, a second plate-like bar member comprised solely of a single vertical plate, the plate and thus the second bar member extending perpendicularly to the first bar member, the single vertical plate comprising an upper section extending above the first bar member and a lower section extending beneath the first bar member, the upper and lower sections each having smooth, flat inner and outer side surfaces, and a fastener guide member extending upward from and outward of the second bar member at an oblique angle in relation to the second bar member, said fastener guide member having an open slot extending completely through the fastener guide member.

2. The deck plank spacer and fastener guide tool as in claim 1 wherein the unitary body is fabricated of molded plastic.

3. The deck plank spacer and fastener guide tool as in claim 1 wherein the tool body is fabricated out of a single piece of lightweight metal.

4. The deck plank spacer and fastener guide tool as in claim 1 wherein the width of the second bar member is equivalent to the spacing required between deck planks to be installed adjacent to one another.

* * * * *